United States Patent [19]

Donnelly

[11] Patent Number: 4,600,194

[45] Date of Patent: Jul. 15, 1986

[54] ANTI-VIBRATION DEVICE FOR SPORTS RACKETS

[76] Inventor: Norbert B. Donnelly, 1505 N. Front St., Niles, Mich. 49120

[21] Appl. No.: 564,317

[22] Filed: Dec. 22, 1983

[51] Int. Cl.[4] ..... A63B 49/00

[52] U.S. Cl. ..... 273/73 G

[58] Field of Search ..... 273/73 R, 73 G, 67 R, 273/73 J, 73 C, 72 A, 75; 173/162 R, 162 A; 145/29 B, 61 M; 174/42; 74/604, 574, 5.5

[56] References Cited

U.S. PATENT DOCUMENTS

| | | | |
|---|---|---|---|
| 3,644,660 | 2/1972 | Dulhunty | 174/42 |
| 3,702,189 | 11/1972 | Galich | 273/73 J |
| 3,778,527 | 12/1973 | Nigol | 174/42 |
| 3,941,380 | 3/1976 | Lacoste | 273/73 G X |
| 4,167,646 | 9/1979 | Mathieu | 174/42 |

FOREIGN PATENT DOCUMENTS

| | | | |
|---|---|---|---|
| 2211857 | 7/1974 | France | 273/73 G |

*Primary Examiner*—Richard C. Pinkham
*Assistant Examiner*—Matthew L. Schneider
*Attorney, Agent, or Firm*—Krass and Young

[57] ABSTRACT

A vibration damping device which may be releasably secured to the throat portion of a sports racket. The device employs a clamping member which may be releasably secured to the frame defining the throat portion of the racket, and a damping member fixedly secured to the clamping member in a cantilevered fashion. A first vibration of the head portion of the racket caused by the impact of the game ball with the racket face induces a second vibration in the damping member, resulting in a damping of the first vibration and reduction in the transmission of vibration to the handle of the racket.

9 Claims, 7 Drawing Figures

ANTI-VIBRATION DEVICE FOR SPORTS RACKETS

TECHNICAL FIELD

This invention relates generally to sports rackets and more particularly to means for damping vibrations in the racket caused by the impact of a ball or other projectile upon the face thereof.

BACKGROUND ART

In several racket sports, such as tennis and racketball, the players employ a racket for striking the game ball in order to place it in the opponents playing area. As a player makes his shot, the racket often vibrates as a result of the impact force of the game ball on the racket face. These vibrations, particularly in the case of metal-framed rackets, are transmitted along the handle of the racket and, in some cases, to the player's arm.

Players often tighten their grip on the racket handle in order to reduce the uncomfortable feeling produced by racket vibration. While this tightened grip tends to dampen the vibrations, it increases the strain on the player's arm and is likely to promote muscle fatigue.

U.S. Pat. No. 3,941,380, issued to Lacoste, discloses a damping mechanism for implements such as baseball bats and tennis rackets employing an elongated vibratable member formed of an elastomeric, energy absobring material. In the Lacoste devices, the energy absorbing material is typicaly embedded in the handle. In the case of a metal racket having an open throat, each end of the elongate material is permanently bound to either side respectively of the throat portion of the racket.

The devices disclosed by Lacoste have several limitations. The Lacoste devices are typically installed only during the construction of the racket, are an integral part of the racket, and are not easily removable from the racket once they are installed. In addition, Lacoste does not provide a means for mounting an elongate energy absorbing member in a cantilevered fashion on the throat portion of the racket.

The present invention is directed to overcoming one or more of the problems as set forth above.

DISCLOSURE OF THE INVENTION

In accordance with one aspect of the present invention, a vibration damping device for sports rackets is provided, the damping device including a housing, clamping means for releasably securing the housing to the throat portion of the racket and a vibrating damping member fixedly secured to the housing in a cantilevered fashion. Vibrations of the racket head induced by the impact of the game ball upon the face of the racket in turn induce vibration of the damping member. This freely vibrating damping member tends to absorb a substantial portion of the vibrational energy, thus greatly reducing the transmission of that energy past the throat portion of the racket to the handle.

In one embodiment of the invention, a vibration damping device employs a single elongate damping member fixedly mounted in a cantilevered fashion at one end to a housing including a clamping mechanism which may be detachably secured to the throat portion of a racket having an open throat. In this embodiment, the longitudinal axis of the elongate damping member is coincident with the longitudinal axis of the racket and the member is mounted in the plane of the racket face in the open area of the throat portion.

In another embodiment of the present invention, particularly useful in connection with rackets having a webbed throat portion, a pair of elongate damping members are each fixedly mounted to a single housing, each of the damping members extending along the throat portion on either side respectively of the throat portion and in a plane which is transverse to the plane of the racket face.

In each embodiment, the housing includes adjustable means for regulating the rate of transmission of the vibrational energy from the racket to the damping member. This vibration regulating means is preferably in the form of one or more regulator pads which may be inserted between the retaining plates of the housing and the damping member to inhibit the transmission of vibrational energy from the racket to the damping member. The thickness and density of this regulator pad may be varied in order that the damping device may be tuned to the particular racket upon which it is mounted.

Thus, the present invention provides a vibration damping device for tennis rackets which may be releasably secured to the throat portion of the rackets and tuned to be responsive to the particular vibration range of that racket.

BEST MODE FOR CARRYING OUT THE INVENTION

Figure 1:
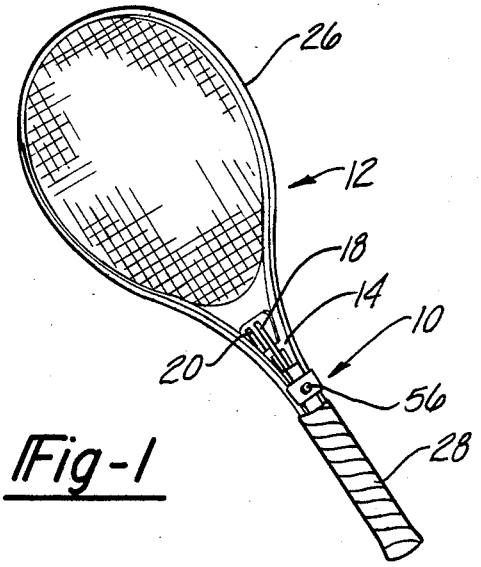
FIG. 1 is a perspective view of one embodiment of the present invention.
Figure 4:
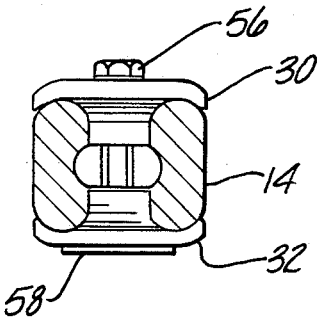
FIG. 4 is an end view of the cross-section of the clamping means mounted upon the throat portion of the racket.
Figure 2:
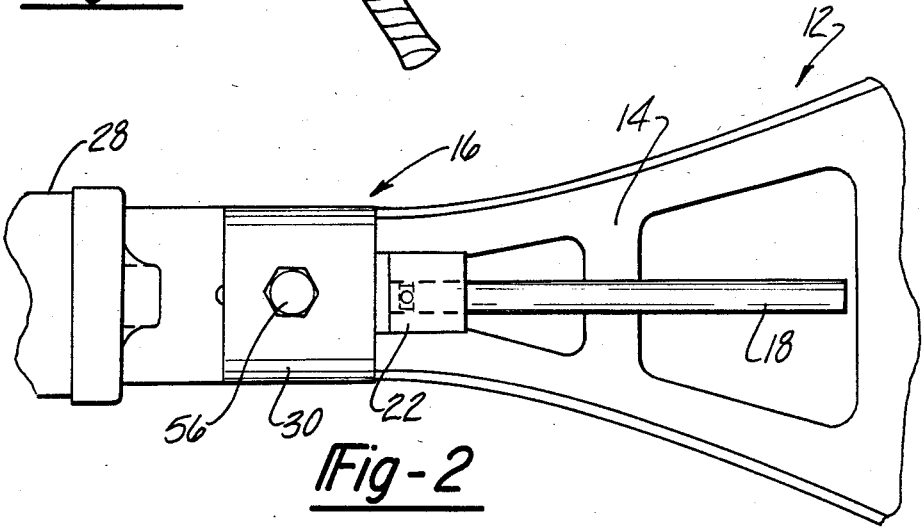
FIG.2 is a top view of the vibration damping device mounted upon the throat portion of a webthroated type racket.

Referring to FIGS. 1 and 2, in one embodiment of the present invention there is provided a vibration damping device 10 for a tennis racket 12 of the type having a webbed or partially closed throat portion 14. The vibration damping device 10 includes a housing 16 which is releasably secured to the throat portion 14 of the racket, including retaining plates 30 and 32, a mount 22 and a pair of elongate damping members 18 and 20 fixedly mounted in cantilevered fashion to the mount 22. The longitudinal axes of the damping members 18 and 20 are generally parallel to the longitudinal axis of the racket 12, and the plane formed by the members 18 and 20 is generally perpendicular to the plane formed by the face of the racket 12. A conventional threaded fastener 56 is employed to releasably secure the housing 16 of the device to the throat portion 14 of the racket.

The retaining plates 30 and 32 are preferably clamped on the throat portion 14 of the racket at a point just above the handle 28. When mounted in this position, the damping member flexes about a pivot point (i.e., the point at which the damping member is secured to the clamp portion) at a point coincident with the pivot point of the flexing racket head 26. As the racket head flexes in a direction perpendicular to the plane of the racket face, the damping member will tend to oscillate in the opposite direction, that is, 180° out of phase with the oscillating racket head 26.

As will be appreciated by those skilled in the art, any vibrations induced by impact of the racket face with the game ball will travel from the frame 26 surrounding the face of racket down to the throat portion 14. At this point a substantial portion of the vibration energy will be absorbed by the vibration damping device 10 resulting in the increased vibration of the damping elements 18 and 20 and a correspondent reduction in vibration energy transmitted to the handle portion 28 of the racket 12. Thus, a substantial portion of the vibration energy which would otherwise be transmitted to the handle of the racket and subsequently to the arm of the racket user is intercepted by the damping device 10 and is dissipated through the harmless vibration of the damping elements 18 and 20.

Referring to FIG. 2, the housing 16 preferably includes a generally planar first retaining plate 30 and second retaining plate 32 positioned generally parallel to each other and mounted on the top and bottom surfaces respectively of the frame forming the throat portion of the racket 12. First and second rod mount bases 38 and 40 are positioned between the first and second retaining plates 30 and 32 in an open area of the throat portion 14 of the racket 12. First and second rod housing sections 34 and 36 extend from the rod mount bases 38 and 40 on either side respectively of cross-member 42 of the throat portion 14 of the racket 12. Each of the damping members 18 and 20 is fixedly secured within the first and second rod housing sections 34 and 36 respectively. In the preferred embodiment, each of the mounting rods 18 and 20 is provided with a notch 19. As the damping rods 18 and 20 are slideably positioned within the rod housings 34 and 36, a protrusion 35 on the inner surface of the housing locks the damping rod into position. It should be noted that other methods of fixedly securing damping rods 18 and 20 to the rod housings 34 and 36 may be utilized without departing from the spirit of the invention.

Figure 3:
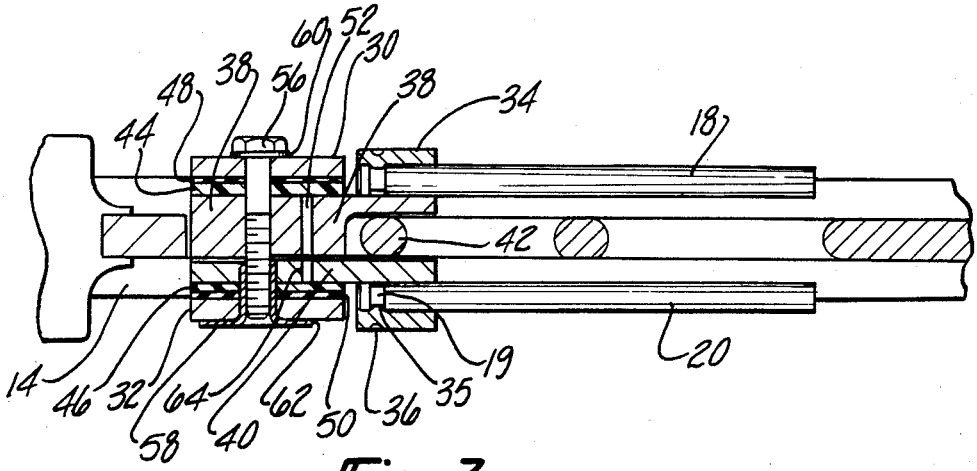
FIG. 3 is a side view of the device shown in FIG. 2 with the clamping means and mounting means shown in cross-section.

It will be appreciated by those in the art that the base portions 38 and 40 of the rod mount 22 could be designed as a single unitary component which might be slidably positioned into place in the open area of the throat portion 14 of the racket 12 without departing from the spirit of the invention. However, the two piece construction of the rod mount 22 shown in FIG. 3 facilitates easier installation of the device.

A pair of spacer elements 44 and 46, preferably made of rigid plastic are located at the top and bottom respectively of the rod mount 22 to insure that, as the first and second retaining plates 30,32 are releasably secured on either side respectively of the racket throat frame 14, the appropriate compressive grip is maintained upon the base portions 38 and 40 of the rod mount 22. A pair of vibration regulator pads 48 and 50 are sandwiched between the inner surfaces of the first and second retaining plates 30 and 32 and the outer surfaces of the spacing elements 40 and 46. The vibration regulator pads 48 and 50 are preferably made of a rubberized cloth and act to absorb a portion of the vibrational energy otherwise transmitted from the retaining plates 30 and 32 to the base portions 38 and 40 of the rod mount 22. It should be noted that the thickness of the rubberized cloth layers which comprise the vibration regulator pads 48 and 50 may be varied according to the desired degree of transmission of energy through the clamp 16, the mount 22, and to the damping elements 18 and 20 according to the specific needs of the user. It should also be noted that it is not crucial that the vibration regulator pads be located between the retaining plates 30 and 32 and the spacer elements 44 and 46 in order to be effective. For example, the pads 48 and 50 may be located between the outer surfaces of the base portions 38 and 40 of the rod mount 22 and the inner surfaces of the spacer elements 44 and 46 to obtain an identical effect.

A hole of diameter sufficient to accommodate a threaded fastener such as a bolt 56, is located on each of the first and second retaining plates 30 and 32, the spacer elements 40 and 46, the vibration regulator pads 48 and 50 and each of the rod mount bases 38 and 40 so that the bolt 56 may be slidably inserted through the assembled components. In the preferred embodiment a portion of the hole through each of the components is of sufficient diameter to accommodate the cylinder portion of a T-nut 58. The bolt 56 is then threadably engaged with the T-nut until the facing surfaces of the bolt head 60 and the T-nut base 62 bear upon each of the first and second retaining plates 30 and 32 with a compressive force sufficient to clamp each of the first and second retaining plates 30 and 32 on either side of the throat portion 14 of the racket 12 and simultaneously clamp each of the remaining components therebetween.

A locating pin 52 is provided for insertion into a pin slot 64 which has been machined in each of the bases 34 and 36 of the rod mount 22 in order to insure accurate positioning of each of the components of the rod mount 22 while it is being secured in place between the retaining plates 30 and 32. It will be appreciated by those skilled in the art that the device of the present invention may be easily assembled, tuned, or removed from the racket 12 by adjusting the fastening means 56 and 58.

Figure 5:
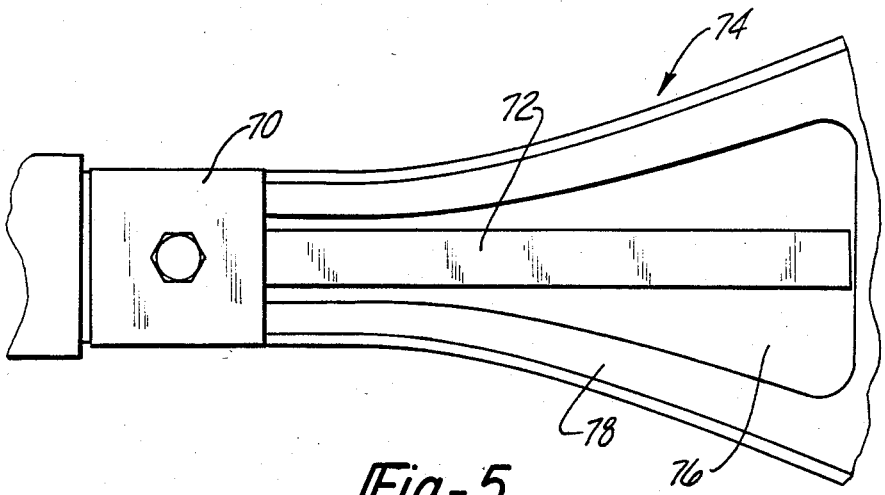
FIG. 5 is a top view of a second embodiment of the present invention.

Referring to FIG. 5, a second embodiment of the present invention is provided for use in tennis rackets which have an open throat portion. This device employs a housing 70 and an elongate damping member 72 fixedly mounted in cantilevered fashion within the housing 70. The longitudinal axis of the elongate damping member 72 runs generally parallel to the longitudinal axis of the racket 74 and is positioned within the open area 76 defined by the supporting structure of the throat portion 78 of the racket. It should be noted that this design is particularly streamlined as the damping member 72 lies in the same plane as the supporting structure of the throat portion 78 of the racket.

Figure 6:
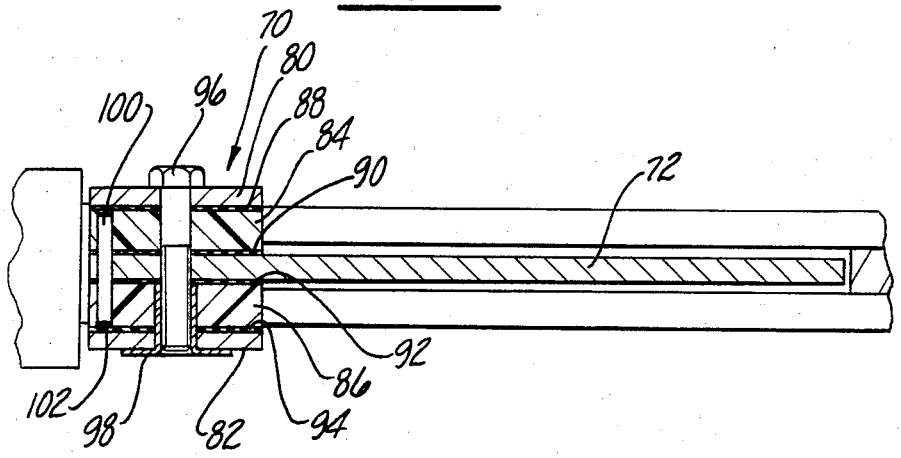
FIG. 6 is a side cross-sectional view of the embodiment shown in FIG. 5.
Figure 7:
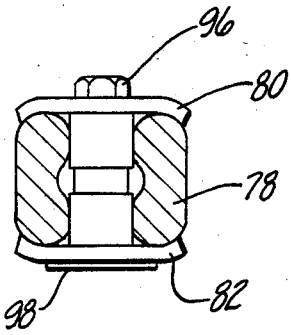
FIG. 7 is an end cross-sectional view of the clamping means mounted upon the throat portion of the racket.

Referring to FIG. 6, the housing 70 of the present invention includes a pair of generally planar retaining plates 80 and 82. Each of the retaining plates 80 and 82 are of sufficient width that they span the opening 76 in the throat portion 78 of the racket and contact the supporting structure on both sides of that opening. The retaining plates 80 and 82 are positioned on each side respectively of the throat portion 78 of the racket.

A pair of spacer elements 84 and 86 are located between the retainer plates 80 and 82 and in the space 76 defined by the supporting structure of the throat portion 78 of the racket. One end of the elongate damping member 72 is slidably positioned between the spacer elements 84 and 86 and the retaining plates 80 and 82. Vibration regulator pads 88 through 94 are positioned between the contacting surfaces of the retaining plates 80 and 82 and the space elements 84 and 86, and the contacting surfaces of the spacer elements 84 and 86 and the elongate damping member 72. These vibration regulator pads may be varied in thickness and number of layers as previously described in connection with the embodiment shown in FIG. 3 in order to adjust the degree of transmission of vibrational energy from the retaining plates 80 and 82 to the spacer elements 84 and 86 and ultimately to the damping member 72. It should again be noted that one or more of the vibration regulator pads 88 through 94 may be removed without departing from the spirit of the invention.

A hole of width sufficient to accommodate an ordinary fastener is provided in each of the first and second retaining plates 80 and 82 and each of the components positioned therebetween. A bolt 96 is inserted through the hole and threadably fastened to a T-nut 98. Bolt 96 is tightened until there is a sufficient clamping force to secure each of the first and second retaining plates 80 and 82 to the supporting structure 78 of the throat portion of the racket and simultaneously secure each of the spacer elements 84 and 86, the damping member 72, and the vibration regulator pads 88 through 94 therebetween. A slot 102 is located in each of the space elements 84 and 86 and in the damping element 72. A locating pin 100 is inserted into this slot for the purposes of maintaining accurate positioning of each of these elements relative to each other.

Thus the vibration damping device of the present invention is easily installed or removed from the throat portion of a tennis racket. In addition, particular embodiments are disclosed which are well suited for installation in rackets having open-throat portions or web type throat portions.

Other aspects, objects and advantages of this invention can be obtained from a study of the drawings, the disclosure, and the appended claims.

I claim:

1. For use with a sports racket having a head portion at one end of the racket, a handle at the other end of the racket and a central throat portion between the head portion and the handle, a vibration damping device comprising:

a housing including coacting clamp members;

fastener means operative upon tightening to secure said coacting clamp members to opposite faces of the throat portion of the racket;

damping means including an elongate rod means; and means operative to clamp one end of said elongate rod means between said coacting clamp members so that said rod means extends in cantilever fashion from said clamp members within the central throat portion of the racket;

whereby a first vibration of the head portion of the racket induces a second vibration in the elongate rod means, resulting in a damping of the first vibration and reduction in the transmission of vibration to the handle of the racket.

2. The vibration damping device of claim 1 wherein said elongate rod means includes a pair of elongate rods extending in cantilever fashion from one side of said clamp members in parallel, spaced relationship and disposed on opposite sides of and parallel to the plane of the racket head.

3. For use with a sports racket having a head portion at one end of the racket, a handle at the other end of the racket an a central throat portion between the head portion and the handle, a vibration damping device comprising:

a housing including a pair of generally planar retaining plates positioned generally parallel to each other, and parallel to the plane of the racket head;

clamping means for securing the housing to the throat portion of the racket; and damping means fixedly secured to the housing in a cantilevered fashion;

wherein the housing further includes vibration regulator means for absorbing a portion of the vibration energy that would otherwise be delivered from the racket to the damping means, and wherein the clamping means comprises fastener means for releasably securing each of the retaining plates on either side respectively of the throat portion of the racket with the vibration regulator means and damping means clamped therebetween.

4. The vibration damping device of claim 3 wherein the vibration regulator means is a pad of rubberized cloth.

5. The vibration damping device of claim 3 wherein the fastener means comprises an elongate bolt and T-nut.

6. The vibration damping device of claim 3 wherein the housing includes at least one rigid spacer element positioned between the retaining plates, the spacer element being of sufficient thickness to ensure that, as the first and second retaining plates are releasably secured on either side respectively of the throat portion of the racket, the appropriate compressive grip is maintained upon the damping means.

7. For the use with a sports racket having a head portion at one end of the racket, a handle portion at the other end of the racket and a central throat portion between the head portion and the handle, a vibration damping device comprising:

a housing including a pair of generally planar retaining plates maintained generally parallel to each other and positioned on either side respectively of the throat portion of the racket, each of the retaining plates being generally parallel to the plane of the racket head;

clamping means for securing the housing to the throat portion of the racket; and damping means comprising a pair of elongate rods positioned generally parallel to each other and on opposite sides of the plane of the racket face, each of the elongate rods being secured to the housing in a cantilevered fashion;

wherein the housing further includes vibration regulating means for absorbing a portion of the vibration energy that would otherwise be delivered from the racket to the elongate rods, and a mounting element including means for fixedly securing one end of each of the elongate rods to the element, and wherein clamping means further includes fastening means for releasably securing each of the planar retaining plates on either side respectively of the throat portion of the racket with the vibration regulating means and mounting element secured therebetween.

8. The vibration damping device of claim 7 wherein the vibration regulating means is a rubberized cloth pad.

9. The vibration damping device of claim 7 wherein the housing includes at least one rigid spacer element located between the retaining plates, the rigid spacer element being of a thickness sufficient to ensure that, as the first and second retaining plates are releasably secured on either side respectively of the throat portion of the racket, the appropriate compressive grip is maintained upon the mounting element.

* * * * *